United States Patent [19]

Seto

[11] 3,957,596

[45] May 18, 1976

[54] PRODUCTION OF FLUORINATED HYDROCARBONS

[75] Inventor: Peter Seto, Mississauga, Canada

[73] Assignee: Ontario Research Foundation, Mississauga, Canada

[22] Filed: May 21, 1975

[21] Appl. No.: 579,379

[30] Foreign Application Priority Data

May 21, 1974 United Kingdom ..... 22669/74

[52] U.S. Cl. ..... 204/59 F; 204/62; 204/272; 204/275; 204/292

[51] Int. Cl.[2] ..... C25B 3/08; C25B 15/08; C25B 11/04

[58] Field of Search ..... 204/59 F, 59 R, 60, 204/62

[56] References Cited

UNITED STATES PATENTS

| | | | |
|---|---|---|---|
| 2,806,817 | 9/1957 | Wolfe | 204/59 F |
| 3,298,940 | 1/1967 | Ashley et al. | 204/62 |
| 3,511,762 | 5/1970 | Childs | 204/59 F |
| 3,660,254 | 5/1972 | Dunn | 204/59 F |
| 3,882,001 | 5/1975 | Mills | 204/59 F |

FOREIGN PATENTS OR APPLICATIONS

| | | | |
|---|---|---|---|
| 2,106,870 | 8/1972 | Germany | 204/59 F |

*Primary Examiner*—F. C. Edmundson
*Attorney, Agent, or Firm*—Sim & McBurney

[57] ABSTRACT

Fluorinated hydrocarbons are formed by electrofluorination of the corresponding parent hydrocarbon, typically butane, with hydrogen fluoride. The cell is maintained under superatmospheric pressure and typically at approximately room temperature. Conduction-improving additives are omitted and the electrode gap, turbulence and electrical energy input are controlled to provide improved yield and current efficiency.

10 Claims, 2 Drawing Figures

PRODUCTION OF FLUORINATED HYDROCARBONS

FIELD OF INVENTION

This invention relates to the production of fluorinated hydrocarbons, more particularly to the production of a specific fluorinated hydrocarbon by reaction of the corresponding parent hydrocarbon with hydrogen fluoride.

BACKGROUND TO THE INVENTION

The production of fluorinated hydrocarbons by electrofluorination is a known process and has involved the passage of a current between a nickel electrode and an iron cathode in a copper or steel container. The hydrocarbon, typically one with a boiling point above room temperature, such as hexane and octane, is reacted with hydrogen fluoride at a cooled temperature, usually around 0°C.

While there have been a number of suggestions for improvement in this process, they are characterized by a low yield of the desired fluorocarbon, typically less than above 20%, and by a low current efficiency, typically less than about 6 to 10%.

SUMMARY OF INVENTION

In accordance with the present invention, the electrofluorination process is considerably improved, resulting in considerably higher yield, improved current efficiency in the production of fluoride of the hydrocarbon, such as butane. Additionally, conductivity-improving additives are omitted, minimizing corrosion of the electrodes, even after a long period of continuous service. The process of the invention is particularly useful for the production of low molecular weight fluorocarbons in the $C_2$ to $C_5$ range, although it may be used for higher molecular weight liquid hydrocarbon fluorination.

The process of the invention is carried out by passing the reactants in the liquid phase along a confirmed flow path between closely spaced-apart electrodes between which a controlled voltage is applied. The reactants are maintained in the liquid phase by the application of superatmospheric pressure to the cell. The reactants are passed between the electrodes of the cell in turbulent flow.

The various parameters of the system are carefully controlled within the ranges defined below to obtain improved current efficiency and high yield.

Thus, the electrode gap between the closely spaced anode and cathode is between about 0.05 to about 0.1 inches, typically about 0.06 inches. The liquid reactants pass in turbulent flow along the confined flow path between the electrodes and have a Reynolds Number value of about 6000 to about 20,000, typically about 6000 to about 10,000.

The voltage applied to the electrodes may vary between about 4.5 and about 7 volts, preferably about 5 to about 6 volts. It may be desired in certain instances to increase the surface area of the anode by initially running the anode at a voltage above about 7 volts to corrode the surface of the electrode and thereby increase its surface area.

Alternatively, a large surface area anode may be formed by constructing the anode by pressing a powder of the metal of the anode.

The anode of the cell used in the present invention preferably is formed of substantially pure nickel, particularly nickel containing the following typical amounts of impurities:

| | | |
|---|---|---|
| C | 0.08 wt% | of total |
| Mn | 0.18 wt% | |
| Fe | 0.2 wt% | |
| S | 0.005 wt% | |
| Si | 0.18 wt% | |
| Cu | 0.13 wt% | |

Nickel containing such typical amounts of impurities is commercially available as Nickel 200 (Inco).

In a typical system, using the process of the invention, a current efficiency of 35 to 40% on the basis of total current input and a yield of 75 to 80% of the desired fluorocarbon are obtainable, clearly an improvement on the prior art processes.

DESCRIPTION OF PREFERRED EMBODIMENT

Hydrogen fluoride and butane, or other hydrocarbon or mixture of hydrocarbons, are fed respectively by lines 10 and 12 to an electrolytic cell 18. The cell 18 is maintained under a superatmospheric pressure to maintain the reactants in a liquid state, while the cell 18 is at room temperature, typically 20° to 30°C.

Figure 1:
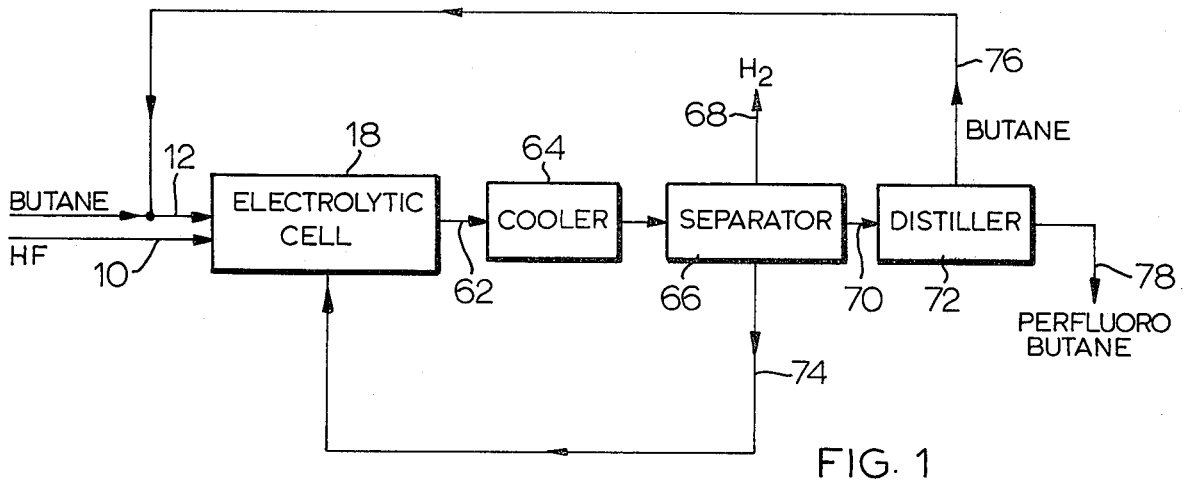
FIG. 1 is a schematic flow sheet of one embodiment of the invention.
Figure 2:
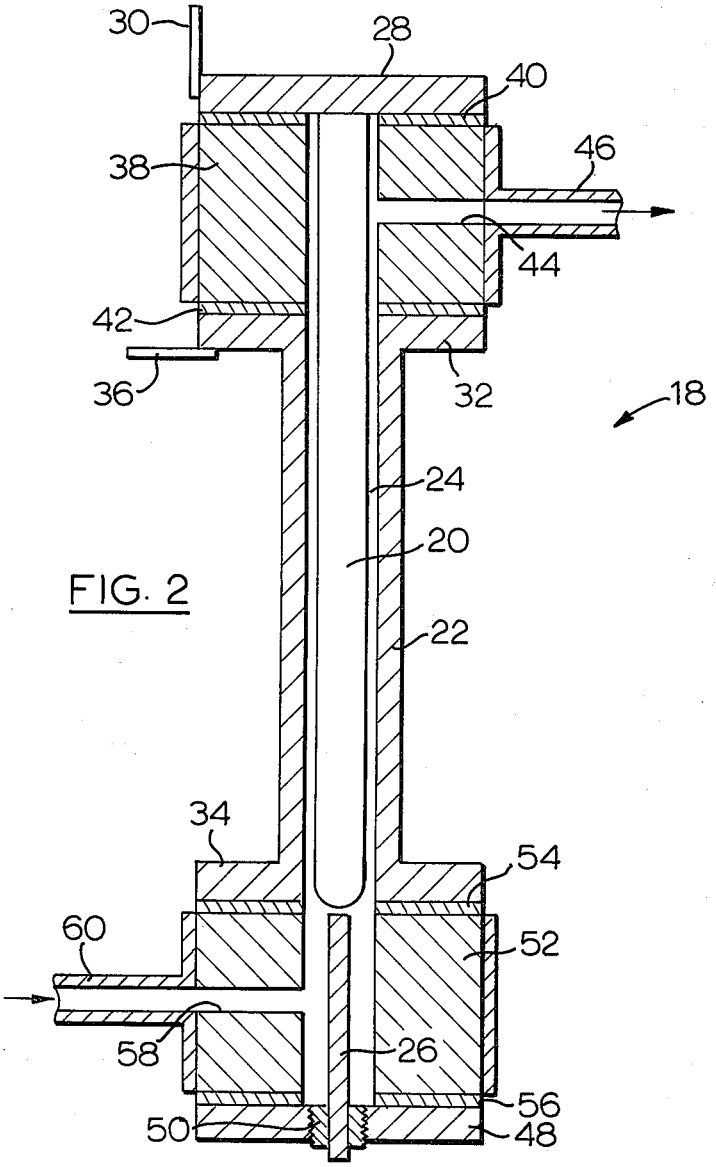
FIG. 2 is a sectional view of an electrolytic cell which may be used in the process of the invention.

The cell 18 may be a cylindrical or rectangular vessel containing a pack of alternate anode and cathode plates fastened together but insulated from one another. Alternatively, the cell may be concentric, as illustrated in more detail in FIG. 2. As seen in FIG. 2, the cell 18 in generally cylindrical form includes an inner rod-like nickel anode 20 and an outer concentric cylindrical mild steel cathode 22 spaced from the anode 20 to define a cylindrical gap 24 through which the reactants flow. A ground electrode 26 also is provided.

The anode 20 is mounted on a disc-like plate 28 of electrically-conducting material to which an electrical terminal 30 is attached for connection to the anode of an external power source.

The cathode 22 is integral with upper and lower annular flanges 32 and 34 respectively of diameter substantially that of the plate 28. An electrical terminal 36 is attached to the upper flange 32 for connection to the cathode of an external power source.

The plate 28 and the upper flange 32 are spaced from each other by a cylindrical member 38 which is electrically isolated from both the plate 28 and the upper flange 32 by first upper and lower annular insulating gaskets 40 and 42.

A bore 44 is formed through the wall of the cylindrical member 38 generally perpendicular to the axis thereof. The bore 44 is in alignment with an outlet tube 46 for the products of the reaction.

At the lower end of the electrode 18, the ground electrode 26 is mounted to a bottom closure disc-like plate 48 of diameter substantially that of plate 28 by a screw 50, or other convenient means.

The plate 48 and the lower flange 34 of the cathode 22 are spaced from each other by a cylindrical member 52 which is electrically isolated from the plate 48 and the lower flange 34 by second upper and lower annular insulating gaskets 54 and 56.

A bore 58 is formed through the wall of the cylindrical member 52 generally perpendicular to the axis thereof. The bore 58 is in alignment with an inlet tube 60 for the reactants.

The provision of the very narrow gap between the adjacent electrodes 20 and 22 allows small quantities of iron fluoride present in the reactant mixture and arising from leaching from the system and the narrow gap to combine to allow the conduction of electricity without external electrical conductivity-improving additives, which, if present, may cause severe corrosion to the process equipment. A high liquid velocity through the cell 18 ensures good dispersion of the butane in the hydrogen fluoride while a high turbulent flow provides a good transfer rate of reactant and product species at the electrode surfaces.

The passage of current between the anode and cathode results in fluorination at the anode. By careful control of the electrical energy input and the flow turbulence in the vicinity of the electrodes by controlling the various parameters within the ranges discussed above, the hydrocarbon is fluorinated to the corresponding perfluorocarbon at high current efficiency, good yield and product purity.

The effluent stream leaving the electrode gaps consists of a mixture of gases and liquids, which is separated in the top portion of the cell. Recycle of the liquid phase through the cell may occur, along with makeup hydrocarbon and hydrogen fluoride for further fluorination, if desired.

The vapor phase is continuously withdrawn from the cell 18 by line 62 and passed through a low temperature cooler 64 to condense the condensable portion of the vapor phase and thence into a separator 66. From the separator 66, the noncondensible gases, consisting mainly of hydrogen, are vented by line 68 from the separator 66, for collection, if desired.

The condensed vapor settles into three mutually-saturated liquid phases, namely hydrocarbon, hydrogen fluoride and perfluorocarbon. The perfluorocarbon phase usually contains about 96% of the desired material, with the impurity being parent hydrocarbon.

The perfluorocarbon phase is withdrawn from the separator 66 by line 70 and passed to a fractionaly distillation column 72 for further purification, if desired. The hydrocarbon and hydrogen fluoride separated in the separator 66 may be recycled by line 74 to the cell 18, if desired. Butane removed from the perfluorocarbon by fractional distillation in the distillation column may be recycled by line 76 to the butane feed line 12 while the purified perfluorobutane is recovered by line 78.

If desired, separation of perfluorocarbon in the separator is avoided and all three phases are recycled to the cell 18 by line 36, until all or substantially all the hydrocarbon is fluorinated.

EXAMPLE

A batch experiment was conducted utilizing the cell of FIG. 2 having an annular electrode gap of 0.06 inches, an effective electrolytic path length of 12 inches and an anode surface area of about 168 sq. cm. Butane was fluorinated with hydrogen fluoride at 25°C under a pressure of 50 psig. A constant d.c. voltage of 5.6 volts was applied with a current density of 0.048 amp/sq. cm. The space time in the cell was about 0.912 secs at a Reynolds number of 6000 to 10,000.

A heavy phase was separated from the gaseous products of the cell and this was found to be 96% perfluorobutane and 3 to 4% butane obtained at a current efficiency of 37%. Small quantities of hexafluoroethane were detected but no partially substituted fluorocarbons and very little polymeric material was formed.

SUMMARY

The present invention, therefore, provides an improved electrofluorination process for the production of fluorinated hydrocarbons. Modifications are possible within the scope of the invention.

What I claim is:

1. A process for the production of a fluorinated hydrocarbon by electrofluorination which comprises.

passing a liquified $C_2$ to $C_5$ hydrocarbon and liquified hydrogen fluoride along a confined flow path between a nickel anode and a conductive metal cathode spaced apart from about 0.05 to about 0.1 inches, in the substantial absence of externally-added electrical conductivity-improving additives, maintaining said hydrocarbon and hydrogen fluoride in said liquified form along said confined path by the application of superatmospheric pressure to said hydrocarbon and hydrogen fluoride in said confined path, flowing said liquified hydrocarbon and hydrogen fluoride along said confined path at a Reynolds Number value of about 6000 to about 20,000, applying a voltage of from about 4.5 to about 7 volts across said electrodes, reacting said hydrocarbon with said hydrogen fluoride in said confined path under the influence of the electrical energy applied across the electrodes, removing reaction mixture from said confined path, and separating a fluorinated hydrocarbon from said reaction mixture.

2. The process of claim 1 wherein said hydrocarbon is butane.

3. The process of claim 1 carried out at temperature of about 20° to about 30°C.

4. The process of claim 1 wherein said Reynolds Number value is from about 6000 to about 10,000.

5. The process of claim 1 wherein said voltage is about 5 to about 6 volts.

6. The process of claim 1 wherein said Reynolds Number value is from about 6000 to about 10,000, said voltage is about 5 to about 6 volts and said process is carried out at a temperature of about 20° to about 30°C.

7. The process of claim 6 wherein said hydrocarbon is butane and said fluorinated hydrocarbon is perfluorobutane.

8. The process of claim 6 wherein said nickel anode is substantially pure nickel containing the following impurities:

| | |
|---|---|
| C | about 0.08 wt% |
| Mn | about 0.18 wt% |
| Fe | about 0.2 wt% |
| S | about 0.005 wt% |
| Si | about 0.18 wt% |
| Cu | about 0.13 wt%. |

9. The process of claim 1 wherein said confined path is constituted by an annular gap provided between an elongate nickel rod anode and a cylindrical mild steel cathode concentrically arranged with respect to the nickel rod.

10. The process of claim 1 wherein said reaction mixture is vaporous and including the further steps of:

cooling said vaporous reaction mixture to form three mutually saturated liquid phases and a gaseous phase, venting the gaseous phase, separating a fluorinated hydrocarbon liquid phase substantially completely from hydrocarbon and hydrogen fluoride liquid phases, recycling the hydrocarbon and hydrogen fluoride phases to the confined path, removing substantially completely residual quantities of hydrocarbon from the separated fluorinated hydrocarbon liquid phase by fractional distillation, and recycling the removed residual quantities of hydrocarbon to the confined path, said phase separation and fractional distillation steps constituting said step of separating fluorinated hydrocarbon from the reaction mixture.

* * * * *